US009377206B2

(12) United States Patent
Kawanaka et al.

(10) Patent No.: US 9,377,206 B2
(45) Date of Patent: Jun. 28, 2016

(54) INDOOR UNIT OF AIR CONDITIONING APPARATUS

(75) Inventors: Masafumi Kawanaka, Sakai (JP); Kenji Terano, Sakai (JP); Susumu Ishii, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1044 days.

(21) Appl. No.: 13/264,015

(22) PCT Filed: Apr. 14, 2010

(86) PCT No.: PCT/JP2010/002688

§ 371 (c)(1),
(2), (4) Date: Oct. 12, 2011

(87) PCT Pub. No.: WO2010/119672

PCT Pub. Date: Oct. 21, 2010

(65) Prior Publication Data

US 2012/0031590 A1 Feb. 9, 2012

(30) Foreign Application Priority Data

Apr. 17, 2009 (JP) ..... 2009-101465

(51) Int. Cl.

| | |
|---|---|
| ***F24F 13/08*** | (2006.01) |
| ***B60H 1/34*** | (2006.01) |
| ***F24F 1/00*** | (2011.01) |
| *F24F 13/22* | (2006.01) |

(52) U.S. Cl.

CPC ..... *F24F 1/0011* (2013.01); *F24F 2001/0037* (2013.01); *F24F 2001/0048* (2013.01); *F24F 2013/221* (2013.01)

(58) Field of Classification Search

CPC ..... F24F 1/0011; F24F 2001/0048; F24F 2001/004; F24F 7/02; F24F 7/065; F24F 13/082; B65D 90/34; F16K 17/19

USPC ..... 454/284, 154–155, 339, 270

See application file for complete search history.

(56) References Cited

U.S. PATENT DOCUMENTS 3,703,141 A * 11/1972 Pernoud ..... 454/155
4,507,940 A * 4/1985 Sato et al. ..... 62/407

(Continued)

FOREIGN PATENT DOCUMENTS

CN 1346955 A 5/2002
EP 1 321 724 A1 6/2003

(Continued)

OTHER PUBLICATIONS

International Search Report of corresponding PCT Application No. PCT/JP2010/002688.

(Continued)

*Primary Examiner* — Helena Kosanovic
(74) *Attorney, Agent, or Firm* — Global IP Counselors

(57) ABSTRACT

An indoor unit of an air conditioning apparatus includes a casing, a heat exchanger, a fan, a first airflow direction adjusting plate adjusting a direction of airflow blown out from an air outlet by rotation about a first axial direction, a plurality of second airflow direction adjusting plates adjusting the direction of the airflow blown out from the air outlet by rotation about a second direction substantially perpendicular to the first direction, and a support member rotatably supporting the first airflow direction adjusting plate in the air outlet other than at both end portions. The second airflow direction adjusting plates include a third airflow direction adjusting plate and a fourth airflow direction adjusting plate placed in a location such that a distance to the support member from the fourth airflow direction adjusting plate is smaller than a distance to the support member from the third airflow direction adjusting plate.

17 Claims, 17 Drawing Sheets

(56) References Cited

U.S. PATENT DOCUMENTS

| | | | | |
|---|---|---|---|---|
| 2005/0279118 | A1* | 12/2005 | Son | 62/408 |
| 2006/0053824 | A1* | 3/2006 | Jung | 62/408 |

FOREIGN PATENT DOCUMENTS

| | | | |
|---|---|---|---|
| EP | 1 808 647 | A1 | 7/2007 |
| JP | 5-79691 | A | 3/1993 |
| JP | 2001-248891 | A | 9/2001 |
| JP | 2003-214696 | A | 7/2003 |
| JP | 2005-180912 | A | 7/2005 |
| JP | 2006-132789 | A | 5/2006 |

OTHER PUBLICATIONS

International Preliminary Report of corresponding PCT Application No. PCT/JP2010/002688.

* cited by examiner 3
20
32b
32b
32b

INDOOR UNIT OF AIR CONDITIONING APPARATUS

CROSS-REFERENCE TO RELATED APPLICATIONS

This U.S. National stage application claims priority under 35 U.S.C. §119(a) to Japanese Patent Application No. 2009-101465, filed in Japan on Apr. 17, 2009, the entire contents of which are hereby incorporated herein by reference.

TECHNICAL FIELD

The present invention relates to an indoor unit of an air conditioning apparatus.

BACKGROUND ART

For example, as described in Japanese Patent Publication No. 2006-132789, there exists an indoor unit of an air conditioning apparatus where a horizontal flap and perpendicular flaps are disposed in order to evenly provide air that has been conditioned with respect to a space inside a room. The horizontal flap can adjust the airflow direction in the up-and-down direction, and the perpendicular flaps can adjust the airflow direction in the left-and-right direction.

SUMMARY

Technical Problem

In an air conditioning apparatus where a horizontal flap is disposed such as described above, sometimes a support member that rotatably supports the horizontal flap is disposed in the neighborhood of the middle of the horizontal flap in the lengthwise direction of the horizontal flap or the like in order to keep the horizontal flap from ending up bending due to its self weight or the like.

In this way, in a case where a support member for the horizontal flap is disposed, there are cases where the distances between the plural perpendicular flaps and the support member are non-uniform. In such cases, sometimes it becomes difficult to evenly expose to cool air the entire surface of the support member and the entire surface of the perpendicular flap that is placed close to the support member. In this case, there is the fear that dew condensation will form at portions not sufficiently exposed to the cool air.

It is a problem of the present invention to provide an indoor unit of an air conditioning apparatus that can suppress the formation of dew condensation between a support member that rotatably supports a first airflow direction adjusting plate and a second airflow direction adjusting plate that performs airflow direction adjustment in a direction differing from that of the first airflow direction adjusting plate.

Solution to Problem

An indoor unit of an air conditioning apparatus of a first aspect is an indoor unit of an air conditioning apparatus and is equipped with a casing, a heat exchanger, a fan, a first airflow direction adjusting plate, plural second airflow direction adjusting plates, and a support member. The casing has an air inlet and an air outlet. The heat exchanger is placed inside the casing. The fan generates an airflow leading from the air inlet to the air outlet. The first airflow direction adjusting plate can, by rotating taking a first direction as its axial direction, adjust the direction of the airflow blown out from the air outlet. The plural second airflow direction adjusting plates can, by rotating taking a second direction that is substantially perpendicular with respect to the first direction as their axial direction, adjust the direction of the airflow blown out from the air outlet. The support member rotatably supports the first airflow direction adjusting plate with respect to the casing at least in a portion of the air outlet other than both end portions in the first direction, and at least one of the support member is disposed. The plural second airflow direction adjusting plates include at least one each of a third airflow direction adjusting plate and a fourth airflow direction adjusting plate that is placed in a location where its distance to the support member is the shortest and which is smaller than the third airflow direction adjusting plate. Here, a case where the fourth airflow direction adjusting plate is smaller than the third airflow direction adjusting plate may, for example, be any of a case where the surface area of the fourth airflow direction adjusting plate is smaller than the surface area of the third airflow direction adjusting plate, a case where the volume of the fourth airflow direction adjusting plate is smaller than the volume of the third airflow direction adjusting plate, a case where the length of the fourth airflow direction adjusting plate in the airflow direction is shorter than the length of the third airflow direction adjusting plate in the airflow direction regardless of their lengths in the second direction, and a case where the length of the fourth airflow direction adjusting plate in the second direction is shorter than the length of the third airflow direction adjusting plate in the second direction regardless of their lengths in the airflow direction. The support member may also rotatably support the first airflow direction adjusting plate at both end portions of the air outlet in the first direction.

Usually, when at attempt is made to cause cool air that has been conditioned to pass through the air outlet, in a case where the distance between the fourth airflow direction adjusting plate and the support member is small, there are cases where it becomes difficult for this cool air to flow in such a way as to go along the entire surface of the fourth airflow direction adjusting plate and the entire surface of the support member.

With respect to this, in this indoor unit of an air conditioning apparatus, first, because the support member is disposed, bending at the portion between both end portions of the air outlet in the first direction can be suppressed. Additionally, even in a case where this support member is disposed, the second airflow direction adjusting plate that is placed in the position closest to the support member is not the third airflow direction adjusting plate but the fourth airflow direction adjusting plate that is smaller than the third airflow direction adjusting plate. For this reason, it becomes easier to allow the cool air to touch the entire surfaces of both the support member and the second airflow direction adjusting plate that is positioned in the neighborhood of the support member. Because of this, temperature irregularities in the entire surfaces of both the support member and the second airflow direction adjusting plate that is positioned in the neighborhood of the support member can be reduced, and the formation of dew condensation can be suppressed. Moreover, not only can the airflow direction be effectively adjusted by the third airflow direction adjusting plate, but at the portion where the fourth airflow direction adjusting plate is disposed, airflow direction adjustment also becomes possible to a certain extent while suppressing the formation of dew condensation.

An indoor unit of an air conditioning apparatus of a second aspect is the indoor unit of an air conditioning apparatus of the first aspect, wherein the support member and the plural second airflow direction adjusting plates are placed in positions where they do not overlap each other in a case where they are seen from the direction of the airflow passing through the air outlet in the casing.

In this indoor unit of an air conditioning apparatus, the support member and the plural second airflow direction adjusting plates are placed in positions where they do not overlap each other as seen in the direction of the airflow passing through the air outlet, so there are cases where the support member and the second airflow direction adjusting plate nearest to the support member cooperatively form air passage resistance. In such cases, it is easy for irregularities to arise in the surface temperatures of the support member and the nearest second airflow direction adjusting plate, and there is the fear that dew condensation will form. In this indoor unit of an air conditioning apparatus, even in a case where an arrangement structure of the support member and the second airflow direction adjusting plates where there is the fear that dew condensation will form in this way is employed, the formation of dew condensation can be suppressed by using the fourth airflow direction adjusting plate for the second airflow direction adjusting plate nearest to the support member.

An indoor unit of an air conditioning apparatus of a third aspect is the indoor unit of an air conditioning apparatus of the first aspect or the second aspect, wherein a distance of closest approach between the shaft of the fourth airflow direction adjusting plate and the support member is the shortest among distances of closest approach between shafts of the plural second airflow direction adjusting plates and the support member.

For example, it is easy for air passage resistance to arise in the space between the support member and the second airflow direction adjusting plate whose shaft is placed in a location that is closest to the support member.

With respect to this, in this indoor unit of an air conditioning apparatus, the formation of dew condensation can be prevented by employing the fourth airflow direction adjusting plate as the second airflow direction adjusting plate whose shaft is placed in a location that is closest to the support member.

An indoor unit of an air conditioning apparatus of a fourth aspect is the indoor unit of an air conditioning apparatus of the first aspect or the second aspect, wherein a distance of closest approach between a rotational driving locus of the fourth airflow direction adjusting plate and the support member is the shortest among distances of closest approach between rotational driving loci of the plural second airflow direction adjusting plates and the support member.

For example, it is easy for air passage resistance to arise in the space between the support member and the second airflow direction adjusting plate most approaching the support member in its driving locus.

With respect to this, in this indoor unit of an air conditioning apparatus, the formation of dew condensation can be prevented by using the fourth airflow direction adjusting plate for the second airflow direction adjusting plate most approaching the support member in its driving locus.

An indoor unit of an air conditioning apparatus of a fifth aspect is the indoor unit of an air conditioning apparatus of any of the first aspect to the fourth aspect, wherein the plural second airflow direction adjusting plates are placed side-by-side in the first direction. As seen in the first direction, at least parts of the second airflow direction adjusting plates and the support member overlap.

In this indoor unit of an air conditioning apparatus, the second airflow direction adjusting plates and the support member are placed in such a way that they have portions that overlap in the first direction, so the apparatus can be miniaturized in regard to direction components that are perpendicular with respect to the first direction.

An indoor unit of an air conditioning apparatus of a sixth aspect is the indoor unit of an air conditioning apparatus of the fifth aspect, wherein the support member has a plate-like portion that extends in the direction of the airflow passing through the air outlet. The plate thickness direction of the plate-like portion is the first direction.

In this indoor unit of an air conditioning apparatus, the support member has a width in the direction of the airflow that passes through the air outlet, so the support member can more stably support the first airflow direction adjusting plate. Additionally, even in a case where the support member employs a shape that stably supports the first airflow direction adjusting plate in this way, its plate thickness direction in the neighborhood of the air outlet coincides with the first direction, so air passage resistance resulting from the support member itself can be kept small.

An indoor unit of an air conditioning apparatus of a seventh aspect is the indoor unit of an air conditioning apparatus of the sixth aspect, wherein in a state where the distance of closest approach between the support member and the fourth airflow direction adjusting plate becomes the smallest as a result of the fourth airflow direction adjusting plate rotating, an angle on a downwind side in the airflow direction of angles formed by the support member and the fourth airflow direction adjusting plate as seen from the second direction is from 10 degrees to 90 degrees.

In a state where the distance of closest approach between the support member and the fourth airflow direction adjusting plate becomes the smallest and the angle on the downwind side becomes 10 degrees or more and 90 degrees or less, cool air that has been conditioned mainly passes in such a way as to go along the surface of the support member on the upwind side and the surface of the fourth airflow direction adjusting plate on the upwind side. In this case, it is difficult for the cool air that has been conditioned to touch the surface of the support member on the downwind side and the surface of the fourth airflow direction adjusting plate on the downwind side, and it is easy for humid warm air convectively flowing from the room to flow in. In this case, it becomes easy for a situation to develop where the temperature differs between the upwind-side surface and the downwind-side surface of the support member and for a situation to develop where the temperature differs between the upwind-side surface and the downwind-side surface of the fourth airflow direction adjusting plate.

With respect to this, in this indoor unit of an air conditioning apparatus, the fourth airflow direction adjusting plate is employed as the second airflow direction adjusting plate nearest to the support member, so it becomes easier to allow cool air that has been conditioned to touch both the upwind-side surface and the downwind-side surface of the support member or both the upwind side and the downwind side of the fourth airflow direction adjusting plate. Because of this, it becomes easier to keep temperature differences between the upwind-side surfaces and the downwind-side surfaces small in the support member and the second airflow direction adjusting plates, and the formation of dew condensation can be suppressed.

An indoor unit of an air conditioning apparatus of an eighth aspect is the indoor unit of an air conditioning apparatus of any of the first aspect to the seventh aspect, wherein the first airflow direction adjusting plate can, by rotating taking the first direction as its axis-of-rotation direction, adjust in an up-and-down direction the direction of the airflow blown out from the air outlet. The plural second airflow direction adjusting plates can, by rotating taking the second direction as their axis-of-rotation direction, adjust in a left-and-right direction the direction of the airflow blown out from the air outlet.

In this indoor unit of an air conditioning apparatus, the direction of the airflow that is blown out can be adjusted in the up-and-down direction by the first airflow direction adjusting plate and in the left-and-right direction by the plural second airflow direction adjusting plates, so the direction in which the airflow is blown out can be adjusted in the up-and-down and left-and-right directions.

An indoor unit of an air conditioning apparatus of a ninth aspect is the indoor unit of an air conditioning apparatus of any of the first aspect to the eighth aspect, wherein the casing has only one of the air outlet. The lengthwise direction of the air outlet is a substantially horizontal direction.

Usually, in a case where there is only one air outlet, the length of the air outlet in the horizontal direction tends to become long in order to ensure a range in which the conditioned air can be supplied. In this way, even in a case where the length of the air outlet in the horizontal direction becomes long, in this indoor unit of an air conditioning apparatus, the support member that supports the first airflow direction adjusting plate is disposed. Because of this, bending of the first airflow direction adjusting plate can be suppressed.

An indoor unit of an air conditioning apparatus of a tenth aspect is the indoor unit of an air conditioning apparatus of any of the first aspect to the ninth aspect, wherein the fourth airflow direction adjusting plate is the smallest of the plural second airflow direction adjusting plates.

In this indoor unit of an air conditioning apparatus, the formation of dew condensation on the surfaces of the fourth airflow direction adjusting plate and the support member can be more effectively suppressed.

An indoor unit of an air conditioning apparatus of an eleventh aspect is the indoor unit of an air conditioning apparatus of any of the first aspect to the tenth aspect, wherein the indoor unit is a ceiling-suspended type.

In this indoor unit of an air conditioning apparatus, the formation of dew condensation can be suppressed even with a ceiling-suspended type.

Advantageous Effects of the Invention

In the indoor unit of an air conditioning apparatus of the first aspect, not only can the airflow direction be effectively adjusted by the third airflow direction adjusting plate, but at the portion where the fourth airflow direction adjusting plate is disposed, airflow direction adjustment also becomes possible to a certain extent while suppressing the formation of dew condensation.

In the indoor unit of an air conditioning apparatus of the second aspect, even in a case where an arrangement structure of the support member and the second airflow direction adjusting plates where there is the fear that dew condensation will form is employed, the formation of dew condensation can be suppressed.

In the indoor unit of an air conditioning apparatus of the third aspect, the formation of dew condensation can be prevented by employing the fourth airflow direction adjusting plate as the second airflow direction adjusting plate whose shaft is placed in a location that is closest to the support member.

In the indoor unit of an air conditioning apparatus of the fourth aspect, the formation of dew condensation can be prevented by using the fourth airflow direction adjusting plate for the second airflow direction adjusting plate most approaching the support member in its driving locus.

In the indoor unit of an air conditioning apparatus of the fifth aspect, the apparatus can be miniaturized in regard to direction components that are perpendicular with respect to the first direction.

In the indoor unit of an air conditioning apparatus of the sixth aspect, air passage resistance resulting from the support member itself can be kept small.

In the indoor unit of an air conditioning apparatus of the seventh aspect, it becomes easier to keep temperature differences between the upwind-side surfaces and the downwind-side surfaces small in the support member and the second airflow direction adjusting plates, and the formation of dew condensation can be suppressed.

In the indoor unit of an air conditioning apparatus of the eighth aspect, the direction in which the airflow is blown out can be adjusted in the up-and-down and left-and-right directions.

In the indoor unit of an air conditioning apparatus of the ninth aspect, bending of the first airflow direction adjusting plate can be suppressed.

In the indoor unit of an air conditioning apparatus of the tenth aspect, the formation of dew condensation on the surfaces of the fourth airflow direction adjusting plate and the support member can be more effectively suppressed.

In the indoor unit of an air conditioning apparatus of the eleventh aspect, the formation of dew condensation can be suppressed even with a ceiling-suspended type.

BRIEF DESCRIPTION OF DRAWINGS

FIG. 12(*b*) is a side view showing a case where the front view left side is seen from section b-b in FIG. 11.

FIG. 12(*c*) is a side view showing a case where the front view left side is seen from section c-c in FIG. 11.

DESCRIPTION OF EMBODIMENTS

1

<1-1> Configuration of Indoor Unit 3 of Air Conditioning Apparatus

Figure 1:
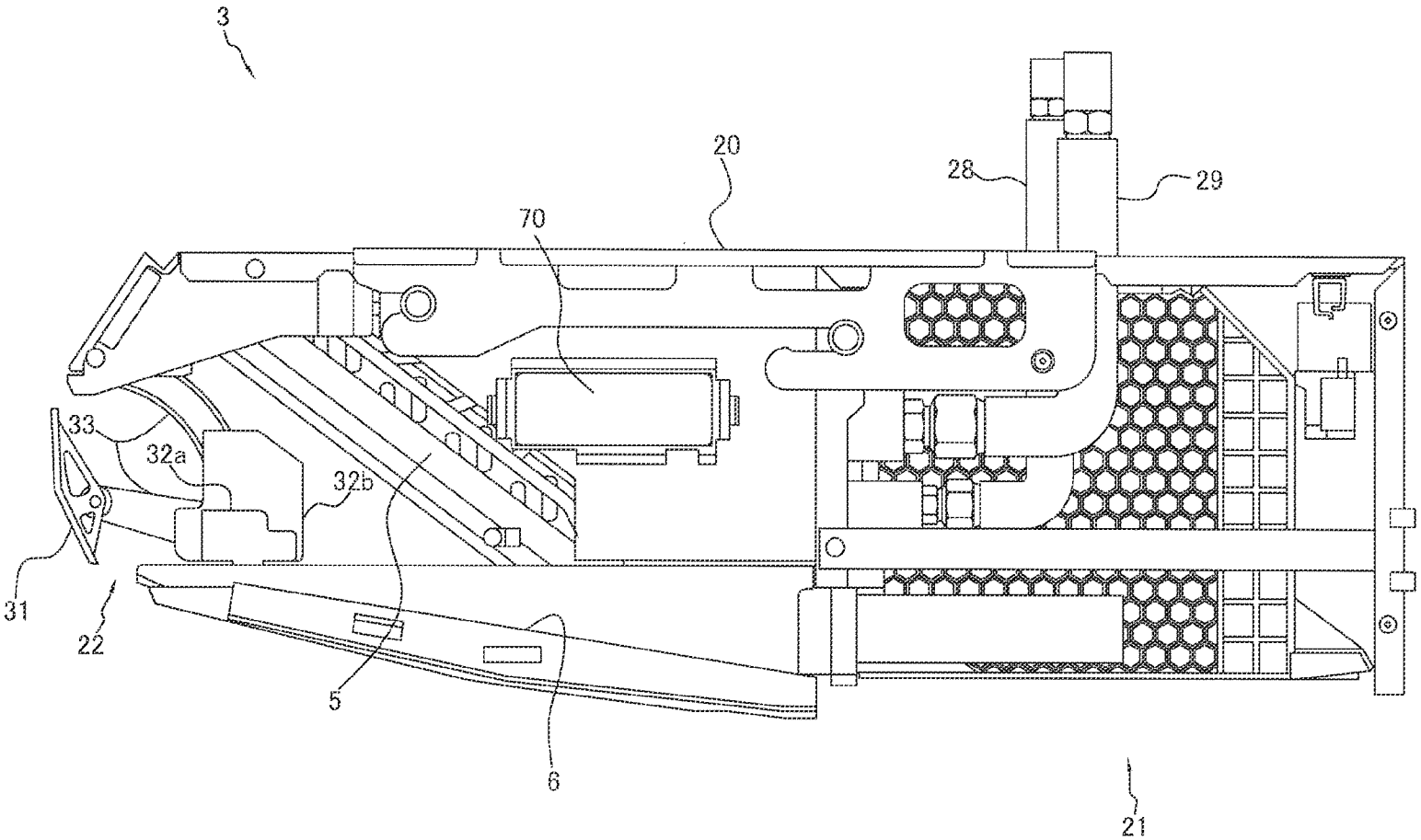
FIG. 1 is a side view schematic explanatory drawing of an indoor unit of an air conditioning apparatus pertaining to an embodiment of the present invention.
Figure 2:
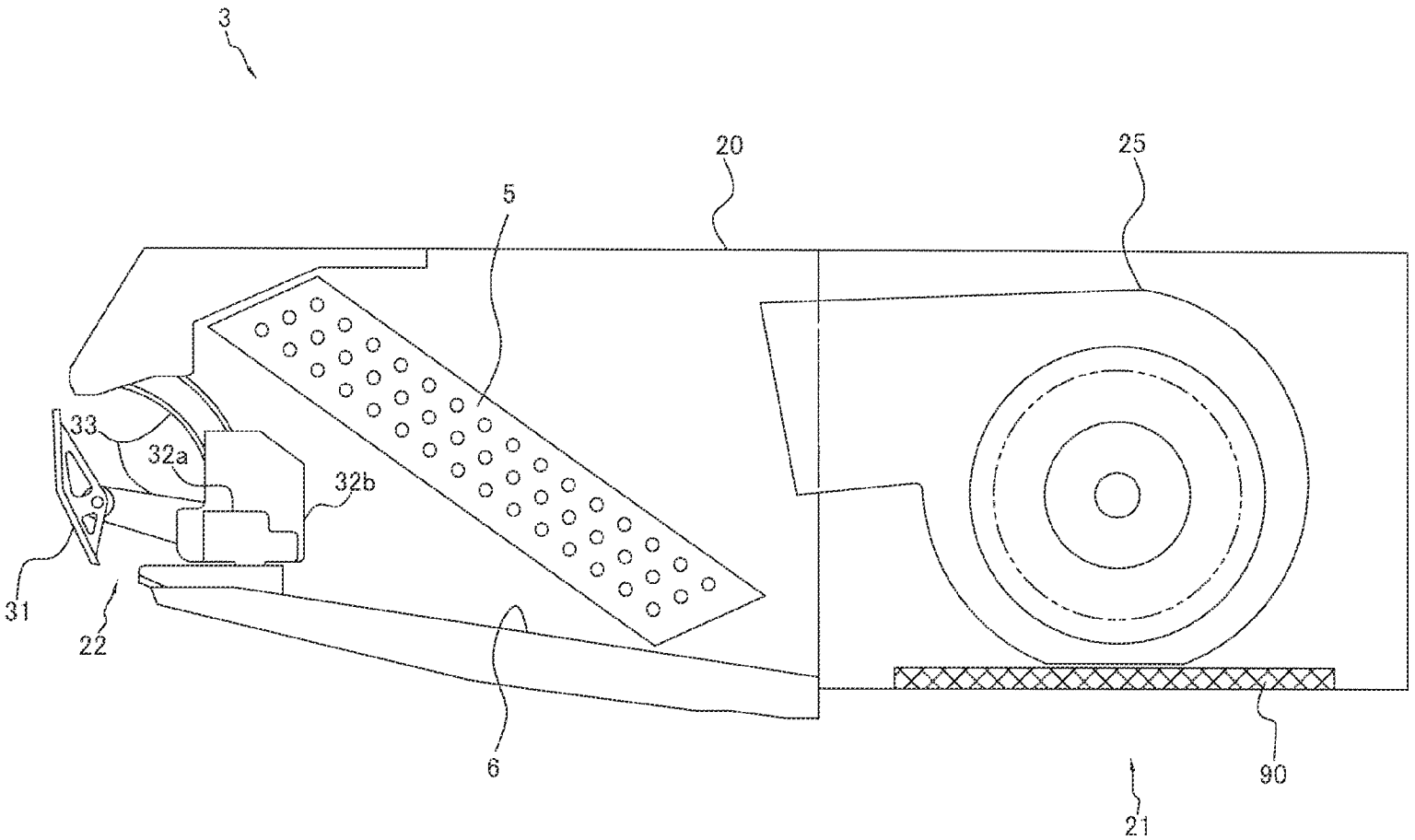
FIG. 2 is a side view schematic arrangement configuration drawing of the indoor unit.
Figure 3:
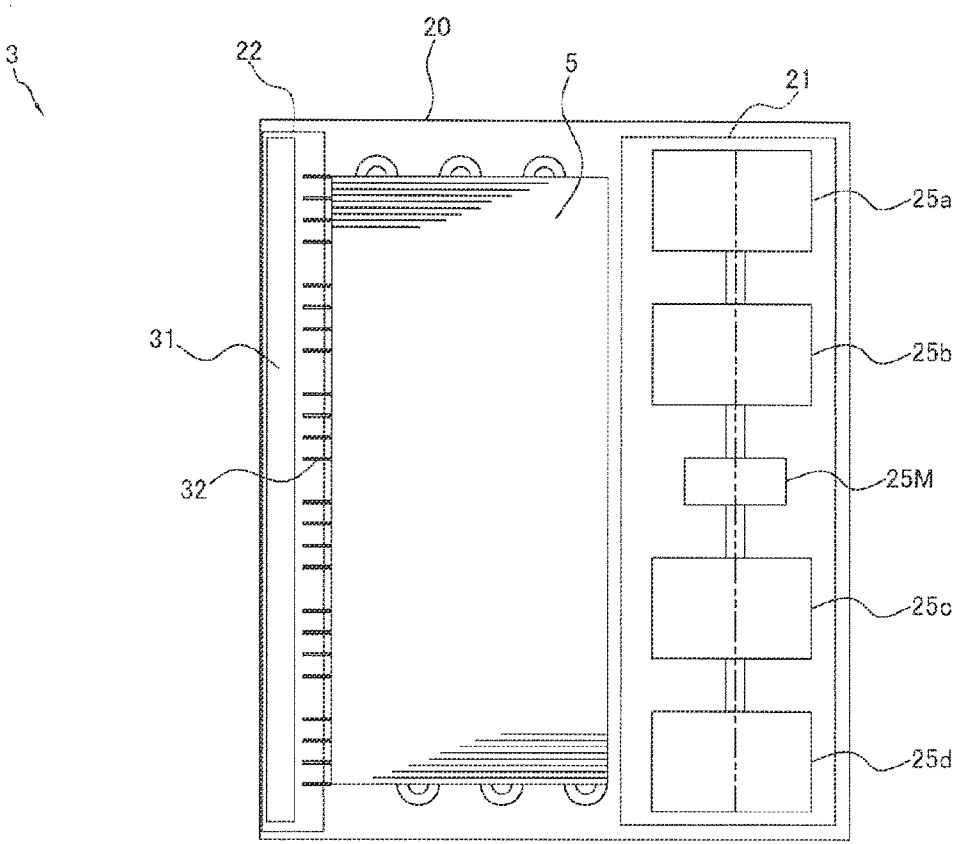
FIG. 3 is a top view schematic arrangement configuration drawing of the indoor unit.
Figure 4:
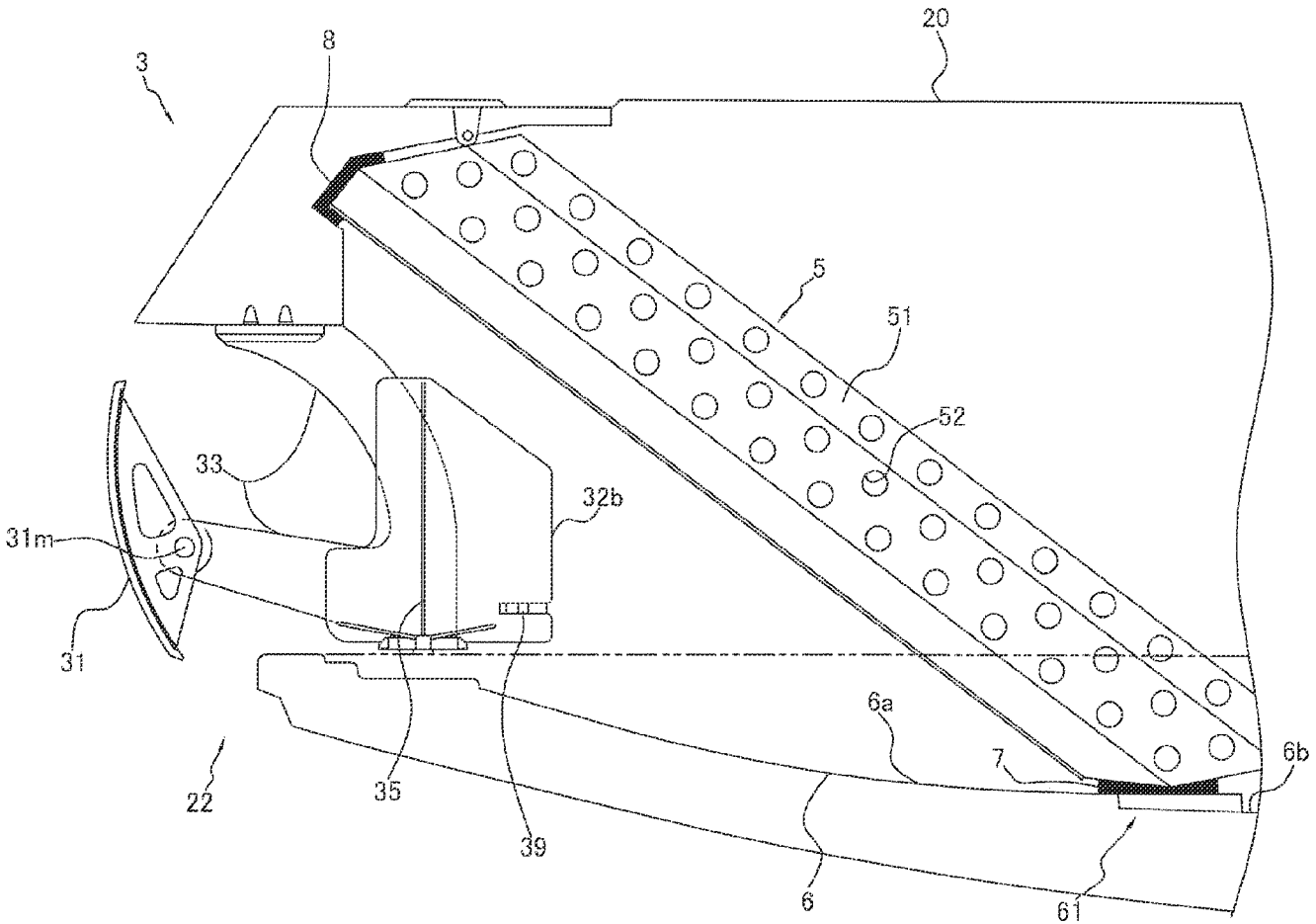
FIG. 4 is a partially enlarged schematic configuration drawing of an air outlet side.
Figure 5:
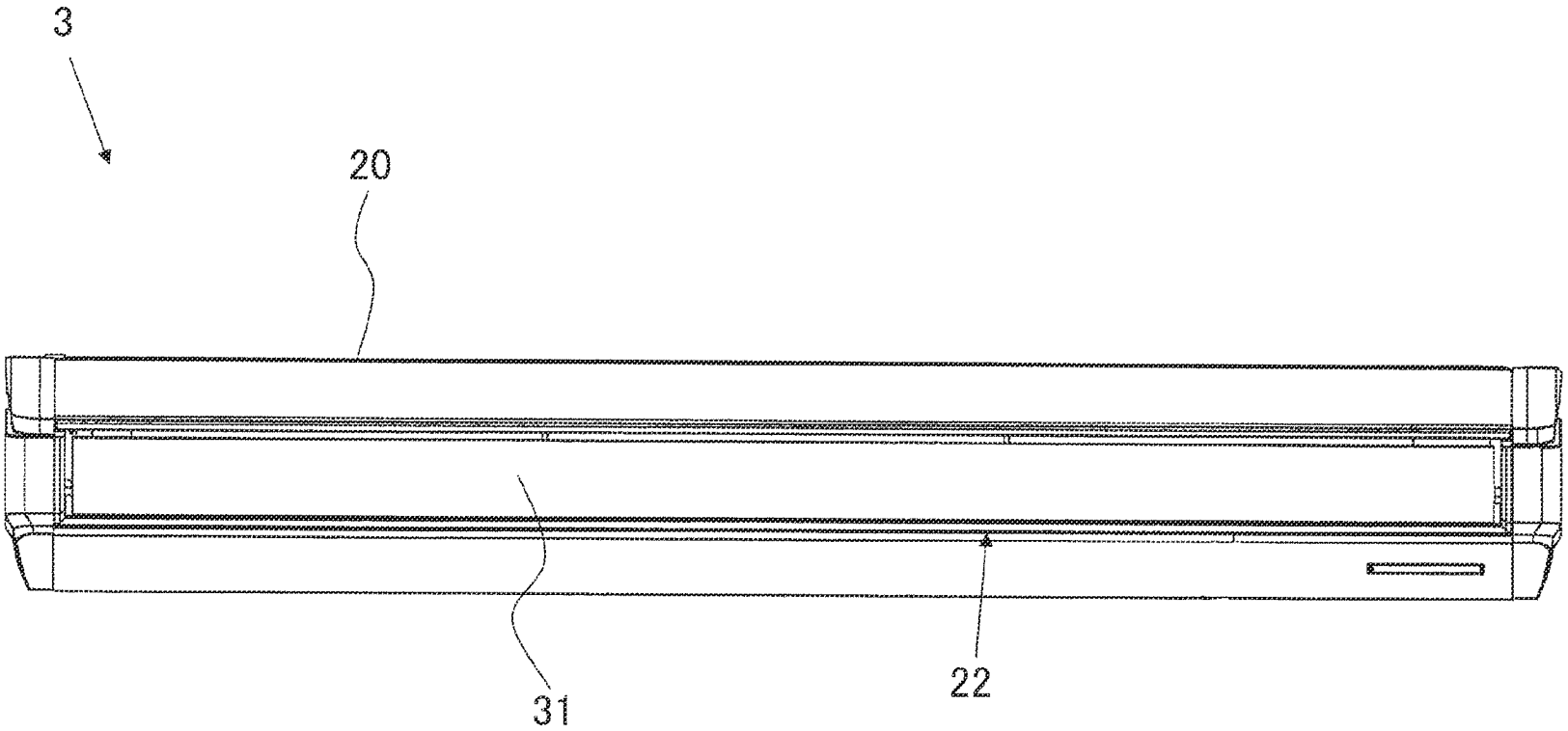
FIG. 5 is a front view of the indoor unit.
Figure 6:
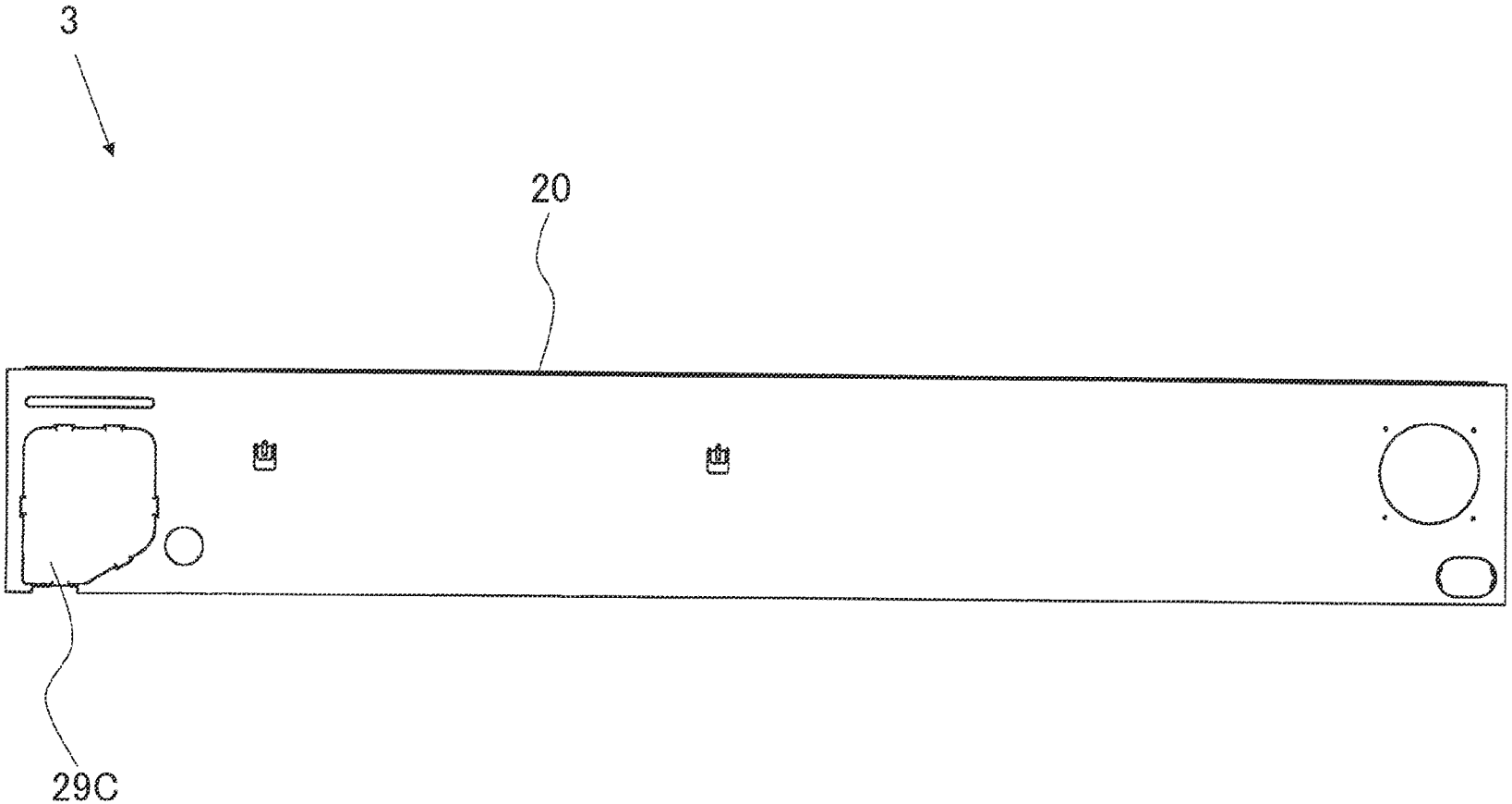
FIG. 6 is a rear view of the indoor unit.

FIG. 1 is a side view schematic configuration drawing of an indoor unit 3 of an air conditioning apparatus pertaining to an embodiment of the present invention. FIG. 2 is an arrangement schematic configuration drawing of the inside of the indoor unit 3 as seen in a side view. FIG. 3 is an arrangement schematic configuration drawing of the inside of the indoor unit 3 as seen in a top view. FIG. 4 is a partially enlarged schematic configuration drawing of an airflow downstream side of the inside of the indoor unit 3. FIG. 5 is a front view of a state where a horizontal flap 31 is most blocking an air outlet 22. FIG. 6 is a rear view of a casing 20.

The indoor unit 3 of an air conditioning apparatus is a ceiling-suspended type of indoor unit that is connected via refrigerant connection pipes to an unillustrated outdoor unit and is placed in the neighborhood of a side wall in an upper space inside a room; the indoor unit 3 of an air conditioning apparatus is equipped with a casing 20, a fan 25, a heat exchanger 5, a drain pan 6, a seal material 7, a seal material 8, a horizontal flap 31, perpendicular flaps 32, support members 33, perpendicular drive bars 39, a filter 90, and a control board 70, etc.

In FIG. 1 and FIG. 2, in the illustrations, the right side represents the rear side, the left side represents the front side, the upper side represents the upper side, and the lower side represents the lower side.

The casing 20 has an air inlet 21, which opens in the vertical direction in the neighborhood of the rear side of the lower surface, and an air outlet 22 (see FIG. 5, etc.), which is disposed in a position somewhat on the lower side from the neighborhood of the substantial center of the front side in the vertical direction and extends in the left-and-right direction as seen in a front view. With respect to the air inlet 21, only one is disposed. Further, with respect to the air outlet 22 also, only one is disposed. Only one air outlet 22 is disposed in the front side, and the front view left-and-right direction coincides with the lengthwise direction of the air outlet 22. On the rear surface of the casing 20, as shown in FIG. 6, there is disposed a cover 29C that is made of resin and is disposed in the neighborhood of the left side end portion illustrated. In the portion blocked by the cover 29C, there is disposed an opening that opens in the plate thickness direction including also the lower end portion. Because of this, in the case of using existing pipes without using a liquid pipe 28 and a gas pipe 29 such as described below, the existing pipes can be passed through the underside of the casing 20 at the time of installation of the indoor unit 3. An unillustrated sheet metal member is fastened by screws to this rear side, whereby the rear side can be made structurally strong even though an opening is disposed in it.

Figure 7:
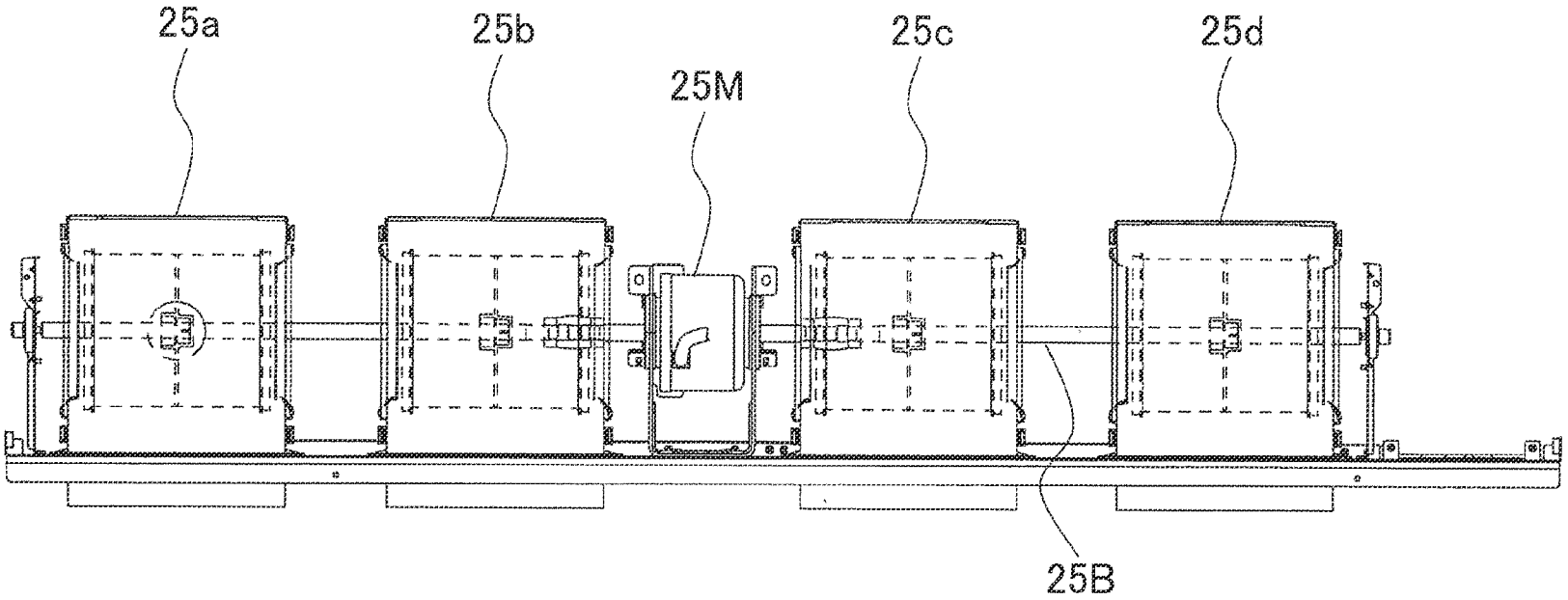
FIG. 7 is a drawing showing the detailed configuration of a fan.

The fan 25 can form an airflow leading from the air inlet 21 to the air outlet 22 inside the casing 20; as shown in FIG. 3 and FIG. 7, the fan 25 has a first sirocco fan 25*a*, a second sirocco fan 25*b*, a third sirocco fan 25*c*, and a fourth sirocco fan 25*d*, which have a common axis, and a fan motor 25M that supplies to these sirocco fans motive power for driving them to rotate. The fan motor 25M is placed between the first sirocco fan 25*a* and second sirocco fan 25*b* and the third sirocco fan 25*c* and fourth sirocco fan 25*d*. In the fan 25, a fan shaft 25B is used to couple together the sirocco fans via couplings and is supported, in such a way that it may freely rotate, by bearings on both ends. In this way, by equally placing two sirocco fans each on the left side and the right side, noise can be reduced.

The heat exchanger 5 has plural heat radiating fins 51, which are placed in such a way that their plate thickness direction coincides with the front view left-and-right direction, and plural heat transfer pipes 52, which are placed in such a way that their lengthwise direction coincides with the front view left-and-right direction and penetrate the plural heat radiating fins 51. In the heat exchanger 5, one step of a refrigeration cycle is performed by causing refrigerant flowing into the heat exchanger 5 from the outdoor unit via the liquid pipe 28 or the gas pipe 29 serving as refrigerant connection pipes to pass through the heat exchanger 5 and thereafter sending the refrigerant back to the outdoor unit via the gas pipe 29 or the liquid pipe 28. The heat radiating fins 51 are placed side-by-side at 1.5 mm intervals in their plate thickness direction. The plate thickness of the heat radiating fins 51 is 0.1 mm.

The drain pan 6 is placed in such a way as to cover the underside of the heat exchanger 5 while ensuring a gap in the vertical direction between the drain pan 6 and the lower end portion of the heat exchanger 5; the drain pan 6 has an upper downstream portion 6*a*, which configures the upper surface of the drain pan 6 and is placed on the downstream side in the airflow direction, and a lower upstream portion 6*b*, which is placed on the airflow direction upstream side of the upper downstream portion 6*a* and configures the upper surface of the drain pan 6 on the lower side of the upper downstream portion 6*a*. On the upper surface of the drain pan 6, there is disposed a concavo-convex shaped portion 61 that is disposed on the border between the upper downstream portion 6*a* and the lower upstream portion 6*b*.

The seal material 7 is placed in the gap between the lower end portion of the heat exchanger 5 and the upper downstream portion 6*a* of the drain pan 6 and is configured by polyethylene foam called opcell or the like.

The seal material 8 is placed in a gap between the upper end portion of the heat exchanger 5 and the undersurface portion of the upper surface of the casing 20 and is configured by polyethylene foam called opcell or the like.

The horizontal flap 31 is placed in such a way as to cover the space above the air outlet 22 in the casing 20, is configured in such a way that its lengthwise direction coincides with the left-and-right direction when seen from the front, and its axis of rotation extends in the left-and-right direction (horizontal direction) as seen in a front view. The horizontal flap 31 can adjust, in the up-and-down direction, the direction of the airflow blown out from the air outlet 22 as a result of its postural angle being changed taking a rotating shaft 31*m* as its center of rotation. The horizontal flap 31 is configured in such a way that, even in a state where it has substantially closed the air outlet 22, a gap having a width in the airflow direction of 10 mm or more (here, about 3 cm) remains between the horizontal flap 31 and the air outlet 22. Because of this, even if the horizontal flap 31 has become the posture where it most blocks the air outlet 22 at the time of shutdown after a cooling operation, circulation of air between the inside of the casing 20 of the indoor unit 3 and the outside of the casing 20 can be ensured to suppress the propagation of various bacteria.

The perpendicular flaps 32 are placed on the airflow direction upstream side of the horizontal flap 31, that is, on the lower end side of the air outlet 22 on the interior side of the casing 20, and rotating shafts 35 extend in the up-and-down direction (vertical direction) as seen in a front view. The perpendicular flaps 32 can adjust, in the left-and-right direction, the direction of the airflow blown out from the air outlet 22 as a result of their postural angles being changed taking the rotating shafts 35 as centers of rotation. The perpendicular flaps 32 include small perpendicular flaps 32*a*, large perpendicular flaps 32*b*, and end portion perpendicular flaps 32*c*. Of these, the small perpendicular flaps 32*a* are placed near the support members 33 and are the smallest among the perpendicular flaps 32.

The support members 33 extend from the upper end of the air outlet 22 in the casing 20 to the neighborhood of the lower end of the air outlet 22 and thereafter extend toward the airflow direction downstream side while heading slightly upward; the support members 33 share with the horizontal flap 31 the rotating shaft 31*m* at their airflow direction downstream side distal ends, whereby the support members 33 rotatably support the horizontal flap 31. The horizontal flap 31 is long in the front view left-and-right direction, so by supporting the horizontal flap 31 midway, bending of the horizontal flap 31 can be suppressed. The plate thickness direction of the support members 33 coincides with the horizontal direction, which is the lengthwise direction of the air outlet 22; in a posture where the perpendicular flaps 32 are not inclined, the plate thickness direction of the perpendicular flaps 32 and the plate thickness direction of the support members 33 become the same, and air passage resistance with respect to the airflow can be kept small.

The perpendicular drive bars 39 are members that lump together four each of the perpendicular flaps 32 and change the postural angles of those perpendicular flaps 32; the perpendicular drive bars 39 obtain driving force from an unillustrated airflow direction adjusting mechanism and change the postural angles of the perpendicular flaps 32.

Figure 8:
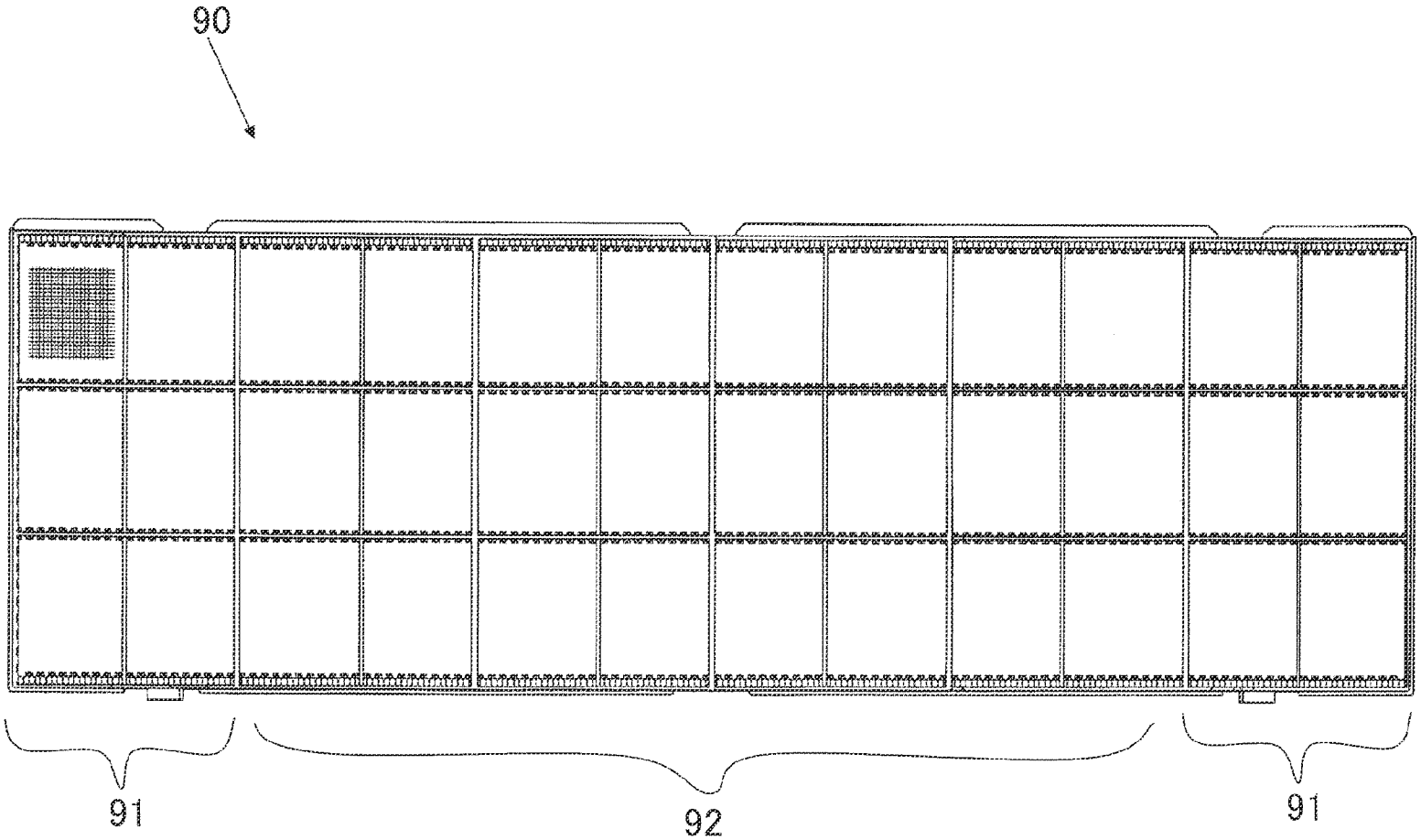
FIG. 8 is a plan view of a filter.
Figure 9:
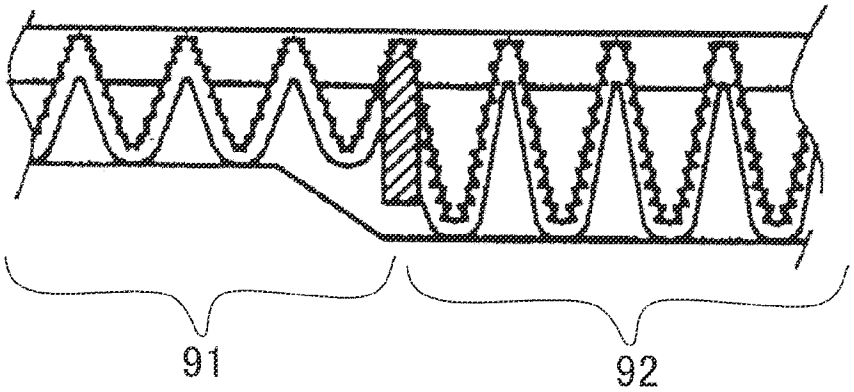
FIG. 9 is a sectional view of the filter.

The filter 90 is mounted in the air inlet 21 in the casing 20; as shown in FIG. 8, which is a plan view, and FIG. 9, which is a side view, the filter 90 has low-thickness portions 91 that are disposed on both the left and right end portions of the filter 90 and a high-thickness portion 92 that is disposed between the low-thickness portions 91. In this way, by disposing portions with differing peak-to-valley heights in the filter 90, the filter 90 can be fitted exactly in the installation position of the filter 90. The pitches configuring the openings in the filter 90 are equally spaced. By giving the filter 90 this structure, the peak-to-valley heights can be made high and the air passage area can be enlarged at portions that do not contact other peripheral parts.

The control board 70 performs control of the aforementioned refrigeration cycle and performs automatic adjustment control of the postural angle of the horizontal flap 31 and the postural angles of the perpendicular flaps 32, etc.

<1-2> Detailed Configuration of Neighborhood of Air Outlet 22

Figure 10:
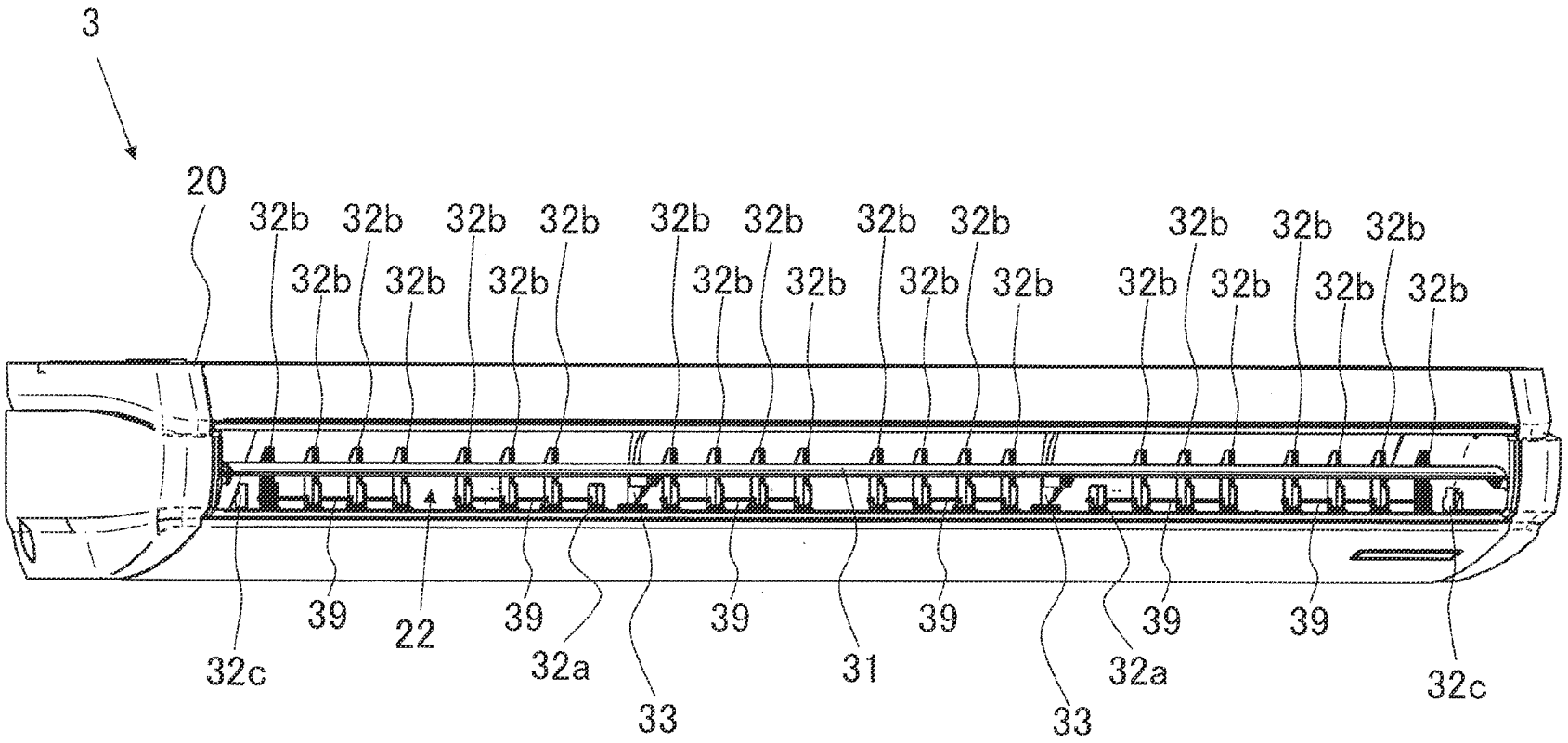
FIG. 10 is a front side perspective view showing the neighborhood of the air outlet.
Figure 11:
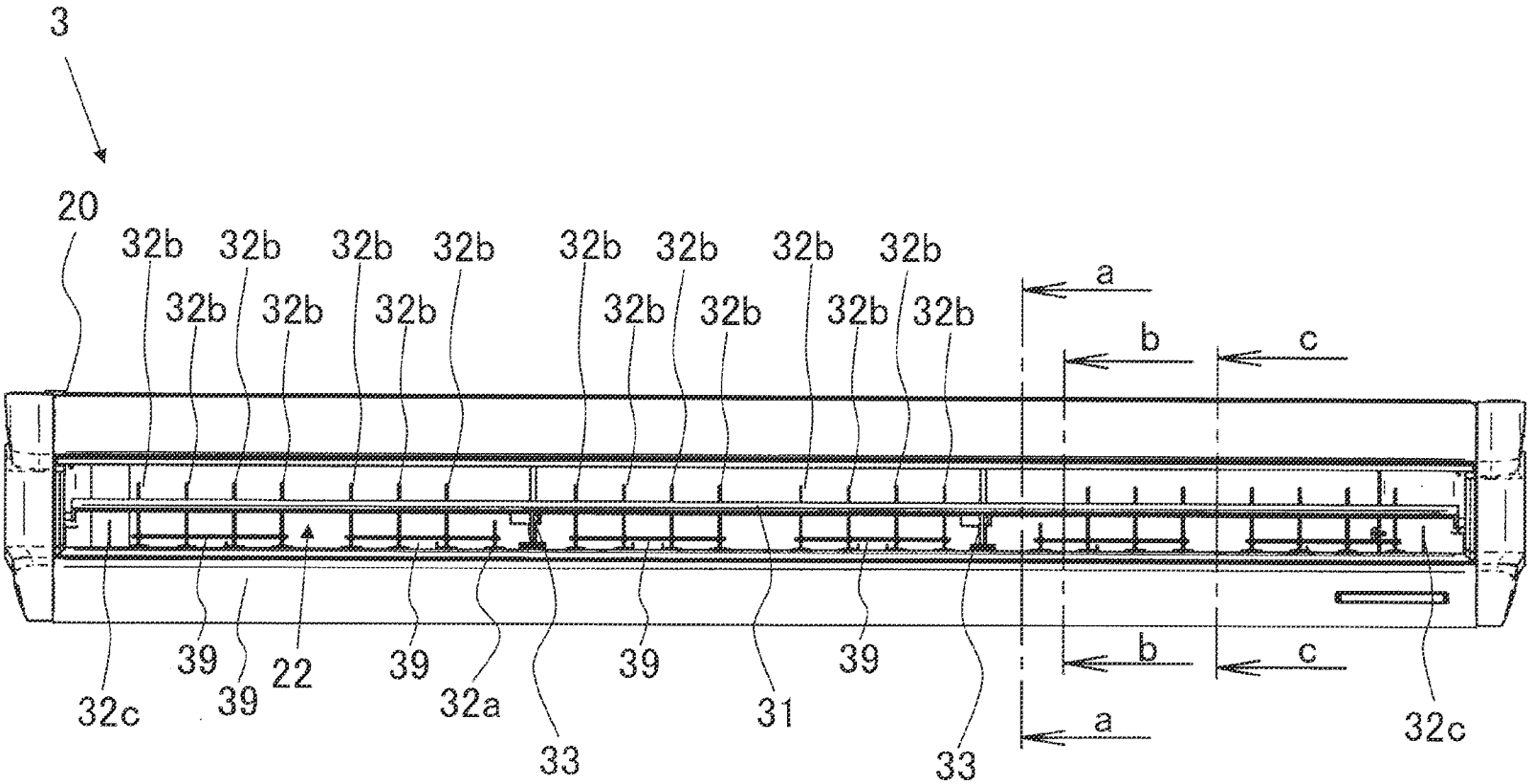
FIG. 11 is a front view showing the neighborhood of the air outlet.
Figure 12:
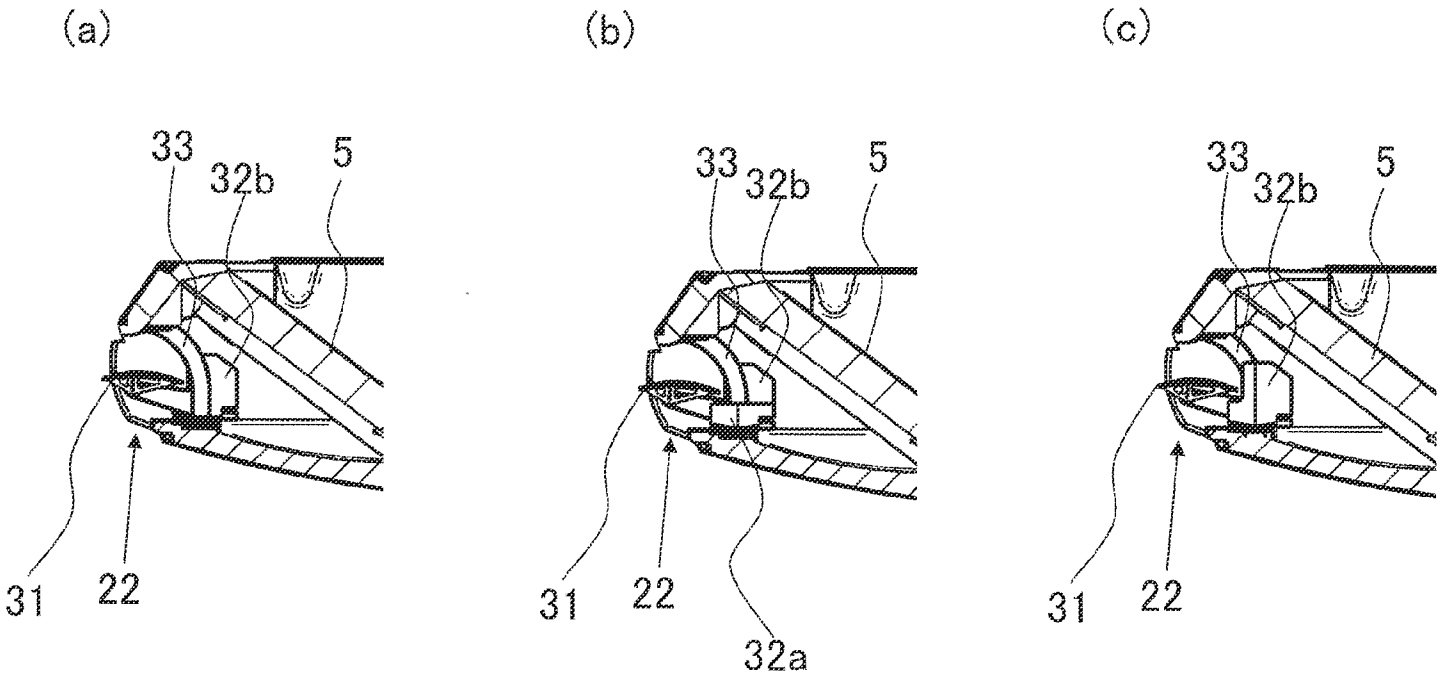
FIG. 12(*a*) is a side view showing a case where the front view left side is seen from section a-a in FIG. 11.
Figure 13:
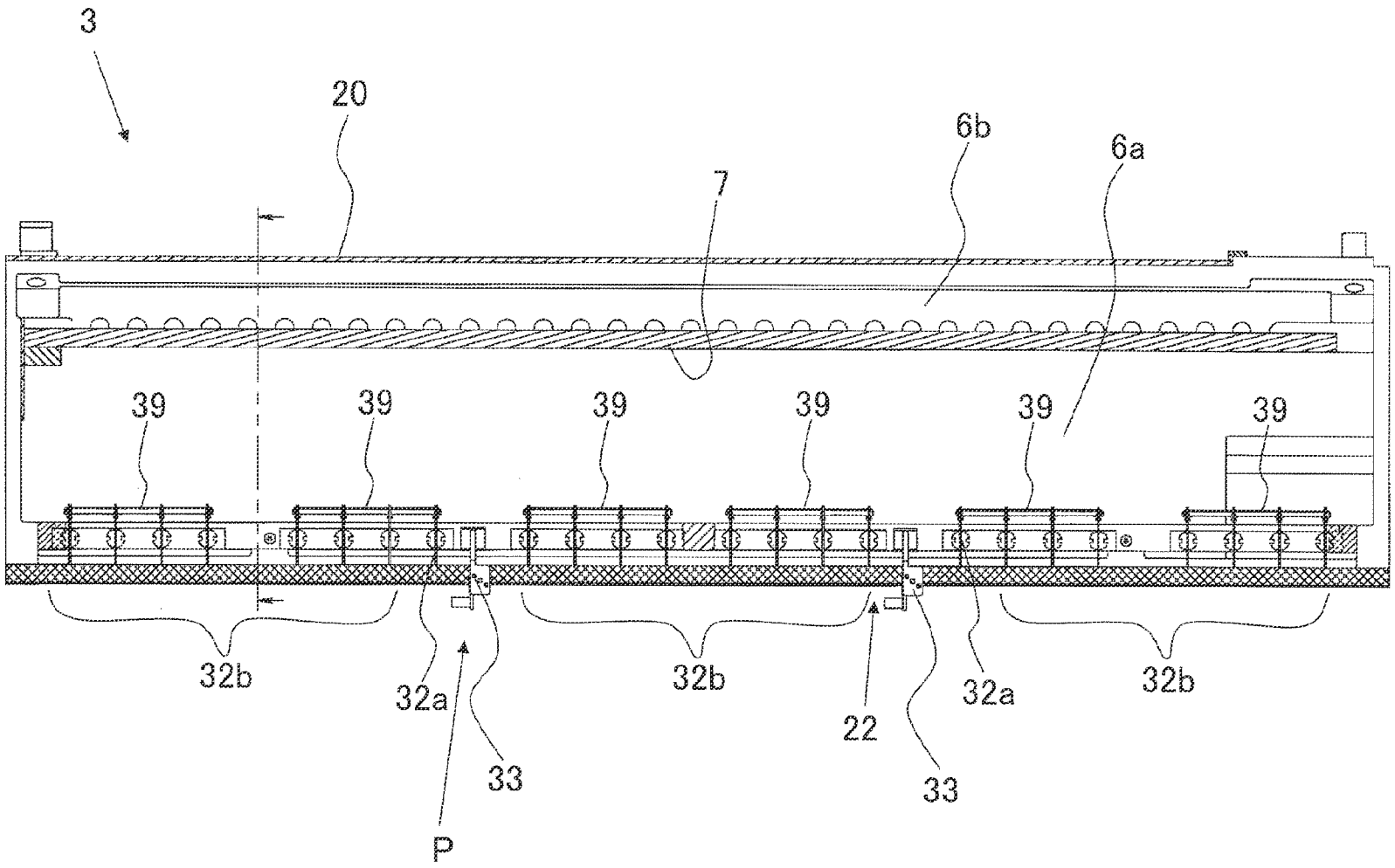
FIG. 13 is a top view showing the lower portion of the interior of the indoor unit in a case where perpendicular flaps are not inclined.
Figure 14:
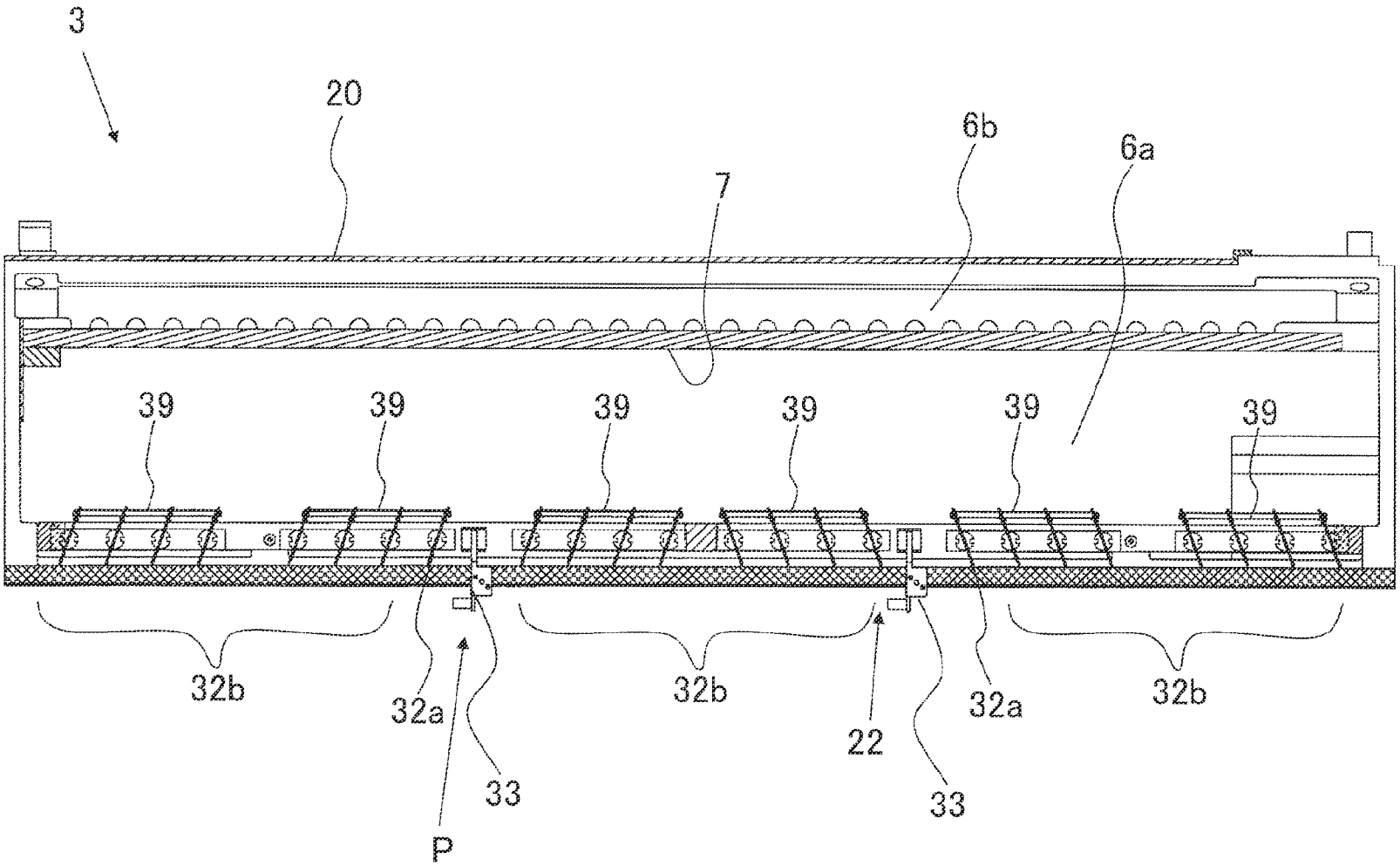
FIG. 14 is a top view showing the lower portion of the interior of the indoor unit in a case where the perpendicular flaps are inclined.

FIG. 10 shows a front side perspective view of the neighborhood of the air outlet 22. FIG. 11 shows a front view of the neighborhood of the air outlet 22. FIG. 12 shows partial sectional explanatory drawings of the neighborhood of the air outlet 22. FIG. 13 shows a top view in a state where the perpendicular flaps 32 are not inclined. FIG. 14 shows a top view in a state where the perpendicular flaps 32 are inclined.

The support members 33 that support the horizontal flap 31 are disposed in two places in such a way as to divide the width of the air outlet 22 in the left-and-right direction substantially equally into thirds.

The end portion perpendicular flaps 32*c* are disposed on both the left and right end portions of the air outlet 22. The distances between the end portion perpendicular flaps 32*c* and the left and right wall surfaces of the air outlet 22 are short, so the end portion perpendicular flaps 32*c* are designed to be small in such a way that it becomes difficult for dew condensation to form on them.

The small perpendicular flaps 32*a* are placed one each in the left and right areas, excluding the middle area, of the areas in the air outlet 22 that is divided equally into thirds by the support members 33. The small perpendicular flap 32*a* placed in the area on the left side is placed farthest to the right among the perpendicular flaps 32 in the area on the left side. The small perpendicular flap 32*a* placed in the area on the right side is placed farthest to the left among the perpendicular flaps 32 in the area on the right side. In this way, left-and-right symmetry of the perpendicular flaps 32 is ensured. Here, the distance of closest approach between the support member 33 on the front view left side and the rotating shaft 35 of the nearest small perpendicular flap 32*a* is shorter than any distance of the distances of closest approach between this support member 33 on the front view left side and the rotating shafts 35 of the other perpendicular flaps 32. Further, as shown in FIG. 14, even in a state where the perpendicular flaps 32 have changed their postural angles, the distance of closest approach between the surface of the support member 33 on the front view left side and the surface of the nearest small perpendicular flap 32*a* is shorter than any distance of the distances of closest approach between the surface of the support member 33 on the front view left side and the surfaces of the other perpendicular flaps 32.

The large perpendicular flaps 32*b* are placed other than in the portions described above; as single groups in which four each of the perpendicular flaps 32 move in the same way, two groups are disposed in the area on the left side, two groups are disposed in the middle, and two groups are disposed in the area on the right side. The perpendicular flaps 32 in each of these groups are lumped together by the corresponding one perpendicular drive bar 39, and the postural angles of the perpendicular flaps 32 in these groups can be changed by group.

As shown in FIGS. 10, 11, and 13, the small perpendicular flaps 32*a*, the large perpendicular flaps 32*b*, the end portion perpendicular flaps 32*c*, and the support members 33 are placed in such a way that none have portions that overlap in the airflow direction as seen in a front view.

FIG. 12(*a*) shows a side view configuration drawing of a state where the front view left side is seen from section a-a in FIG. 11. FIG. 12(*b*) shows a side view sectional drawing of a state where the front view left side is seen from section b-b in FIG. 11. FIG. 12(*c*) shows a side view sectional drawing of a state where the front view left side is seen from section c-c in FIG. 11.

As shown in FIGS. 12(*a*), (*b*), and (*c*), as seen in a side view, the support members 33 and the small perpendicular flaps 32*a* are placed in such a way that they have portions that overlap each other. Because of this, miniaturization in the airflow direction can be achieved compared to a case where the support members 33 and the small perpendicular flaps 32*a* are placed in such a way that they do not overlap as seen in a side view.

<1-3> Characteristics of Present Embodiment

Figure 15:
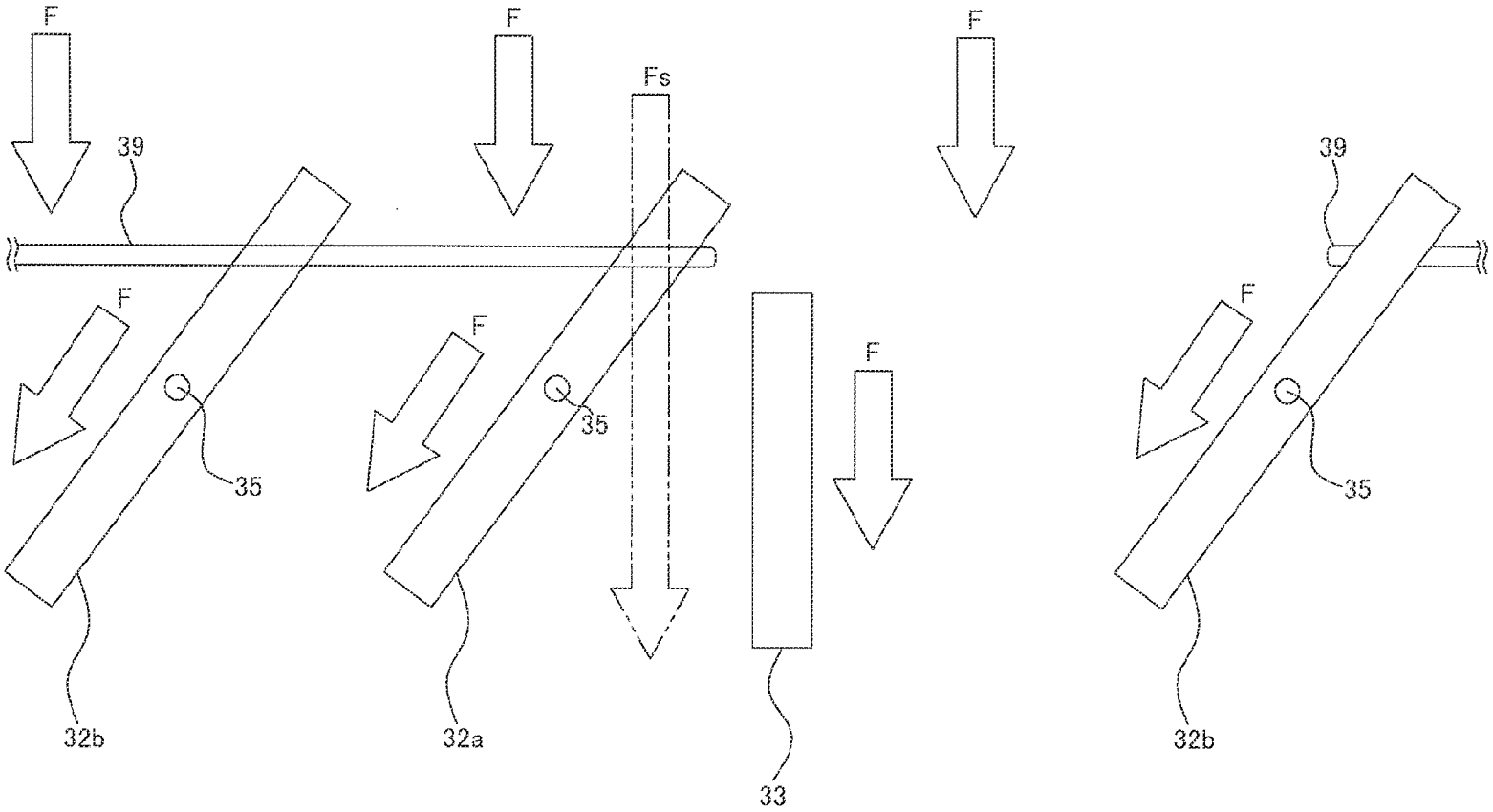
FIG. 15 is a top view showing the formation of dew condensation being suppressed by small perpendicular flaps.

FIG. 15 shows a partially enlarged top view of the portion indicated by arrow view P in FIGS. 13 and 14. Here, the smaller angle of the angles formed by the lengthwise direction of the support member 33 as seen in a top view and the lengthwise direction of the nearest perpendicular flap 32 is about 70 degrees.

Figure 16:
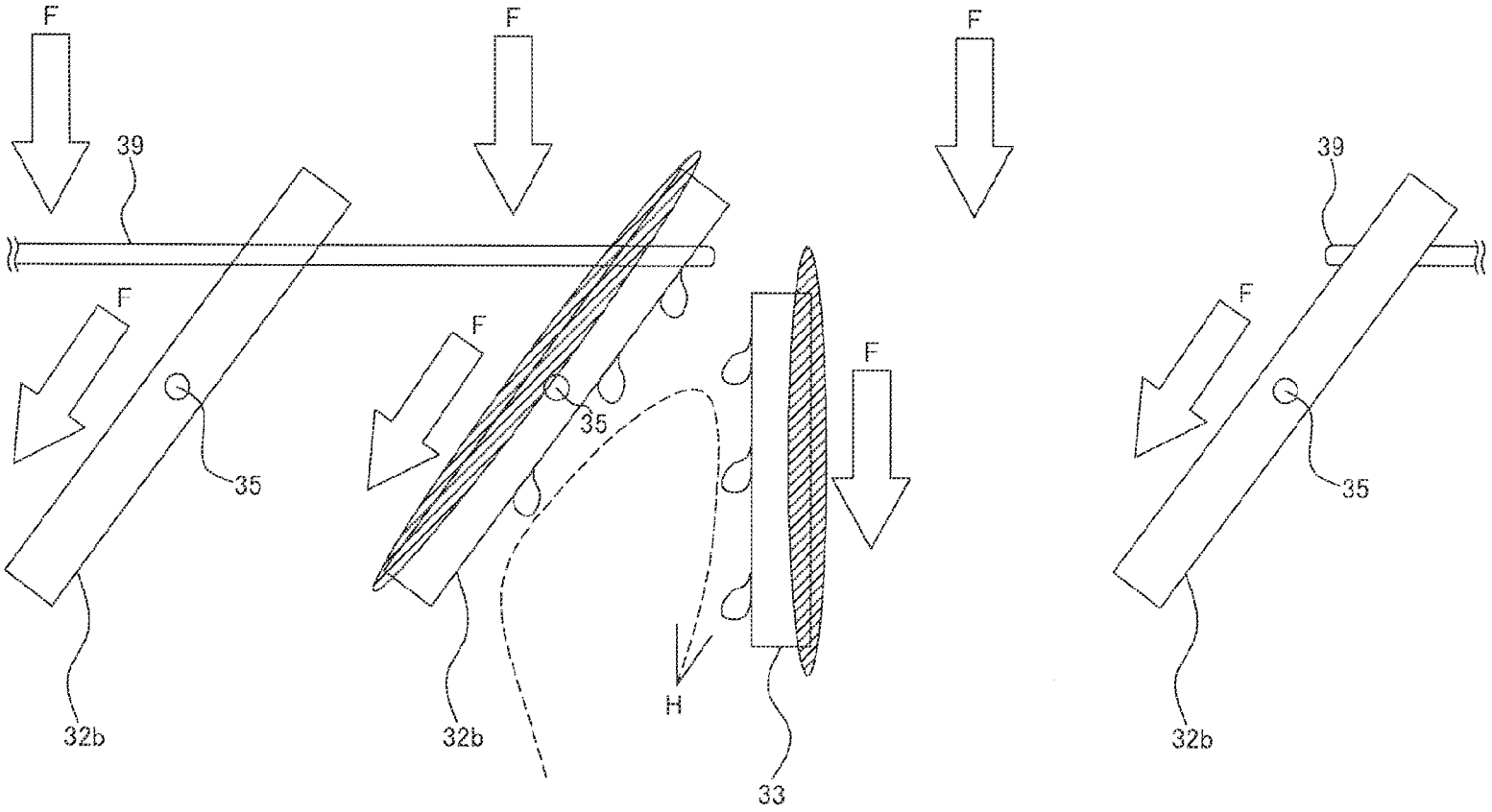
FIG. 16 is a top view showing a comparative example where dew condensation forms because of large perpendicular flaps.

FIG. 16 shows a top view showing a comparative example corresponding to FIG. 15.

In FIG. 16, a case where the perpendicular flap 32 nearest to the support member 33 is a large perpendicular flap 32*b* is shown as a comparative example. In this case, airflows F formed by the fan 25 pass along the right side of the support member 33 and the left side of the nearest large perpendicular flap 32*b* and are blown out into the room. Further, the gap on the upwind side between the support member 33 and the nearest large perpendicular flap 32*b* is small, so it is difficult for the airflows F to flow in between the support member 33 and the nearest lame perpendicular flap 32*b*. In this case, at the time of the cooling operation the airflows F are carrying cool air, so the right side of the support member 33 and the left side of the nearest large perpendicular flap 32*b* are intensively cooled. With respect to this, in the space into which it is difficult for the airflow F between the support member 33 and the nearest large perpendicular flap 32*b* to flow, humid warm air flows in (arrow view H) from the room that is the cooling target space, the humid warm air is cooled on the left side of the support member 33 and the right side of the nearest large perpendicular flap 32*b*, and dew condensation ends up forming.

With respect to this, as shown in FIG. 15, which shows a top view of the support member 33 and the nearest small perpendicular flap 32*a* in the indoor unit 3 of an air conditioning apparatus of the above-described embodiment, the small perpendicular flap 32*a* and not the large perpendicular flap 32*b* is employed as the perpendicular flap 32 nearest to the support member 33, so an airflow Fs of the airflows F passes along the vertical direction upper side of the small perpendicular flap 32*a*. For this reason, cool air at the time of the cooling operation can be supplied also between the support member 33 and the nearest small perpendicular flap 32*a*. Because of this, the entire surfaces of the support member 33 and the nearest small perpendicular flap 32*a* can be cooled by the cool airflows F and Fs, the formation of dew condensation can be supported because it is difficult for irregularities to arise in the surface temperatures, and the formation of dew condensation can be suppressed also from the standpoint that inflow of air from the room can be suppressed.

Further, by disposing the small perpendicular flap 32*a* rather than ending up eliminating the perpendicular flap 32 nearest to the support member 33, it becomes possible to perform left and right airflow direction adjustment somewhat also in regard to the airflow Fs that passes through the portion where the small perpendicular flap 32*a* is positioned.

<2> Other Embodiments

A

In the above-described embodiment, a case where the indoor unit 3 of an air conditioning apparatus is a ceiling-suspended, type has been taken as an example and described.

However, the present invention can also be applied to a case where other flaps are placed near support members that support flaps, so for example, the present invention may also be applied with respect to an indoor unit of a floor-standing type air conditioning apparatus where the lengthwise direction of the air outlet is the vertical direction, in this case, a perpendicular flap is supported by the support member, and the horizontal flap nearest to the support member is miniaturized.

B

In the above-described embodiment, a case where a structure that suppresses dew condensation is employed in regard to the support member 33 on the left side as seen in a front view has been taken as an example and described.

Figure 17:
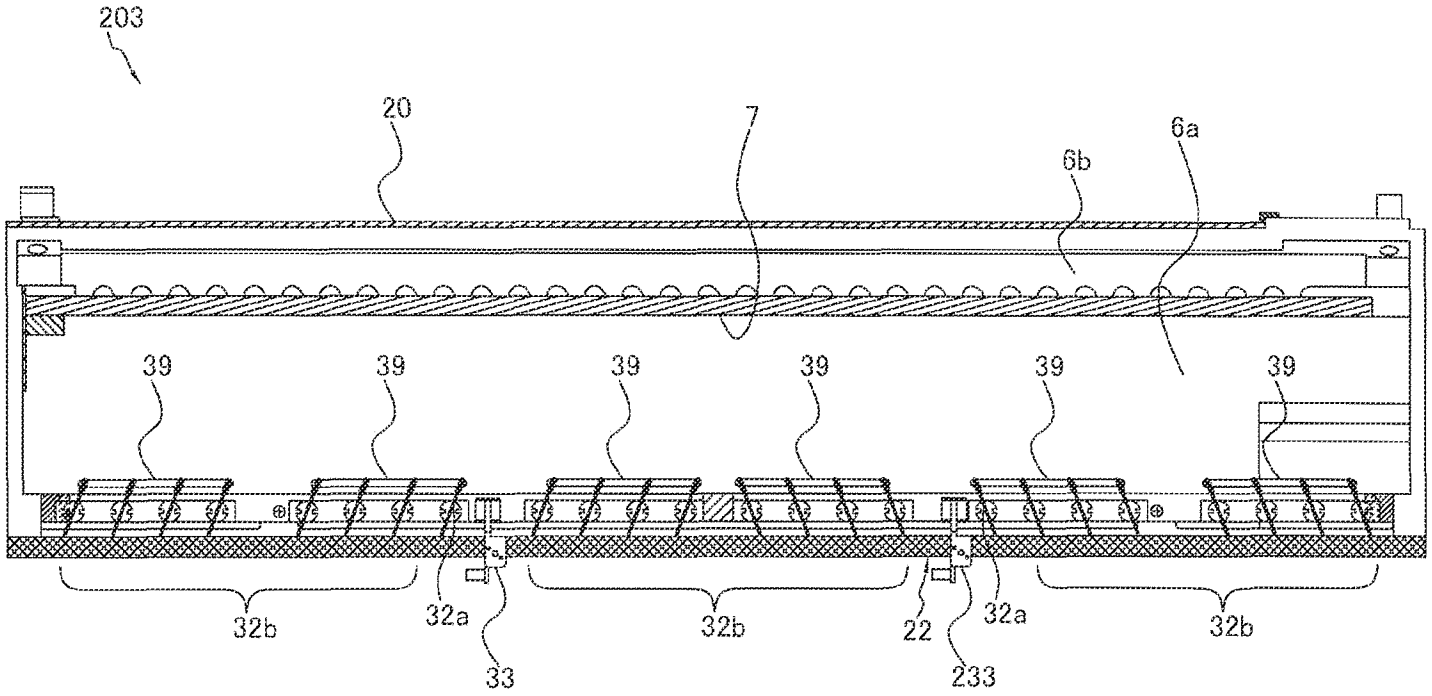
FIG. 17 is a top view of the lower portion of an indoor unit in modification (B).

However, the present invention is not limited to this; for example, as shown in FIG. 17, the present invention may also be configured as an indoor unit 203 of an air conditioning apparatus that employs a support member 233 where the nearest perpendicular flap 32 is a small perpendicular flap 32*a*. In this case, the formation of dew condensation can be suppressed in the neighborhoods of both the support member 33 and the support member 233.

C

In the above-described embodiment, the perpendicular flaps 32 where the small perpendicular flaps 32*a* are smaller than the large perpendicular flaps 32*b* have been described.

However, the perpendicular flaps 32 of the present invention are not limited, to this; for example, focusing on surface area, the perpendicular flaps 32 may also be perpendicular flaps 32 where the surface area of the small perpendicular flaps 32*a* is designed to be smaller than the surface area of the large perpendicular flaps 32*h*.

Further, focusing on volume, the perpendicular flaps 32 may also be perpendicular flaps 32 where the volume of the small perpendicular flaps 32*a* is designed to be smaller than the volume of the large perpendicular flaps 32*b*.

Further, focusing only on airflow direction regardless of length in the vertical direction, the perpendicular flaps 32 may also be perpendicular flaps 32 where the length of the small perpendicular flaps 32*a* in the airflow direction is designed to be shorter than the length of the large perpendicular flaps 32*b* in the airflow direction. Moreover, the perpendicular flaps 32 may also be perpendicular flaps 32 whose lengths in the vertical direction are about the same and where the length of the small perpendicular flaps 32*a* in the airflow direction is designed to be shorter than the length of the large perpendicular flaps 32*b* in the airflow direction. Regarding height position where the airflow is weak in the air outlet 22, the perpendicular flaps 32 may also be perpendicular flaps 32 where the length of the small perpendicular flaps 32*a* in the airflow direction is designed to be shorter than the length of the large perpendicular flaps 32*b* in the airflow direction.

Further, focusing only on length in the vertical direction regardless of length in the airflow direction, the perpendicular flaps 32 may also be perpendicular flaps 32 where the length of the small perpendicular flaps 32*a* in the vertical direction is designed to be shorter than the length of the large perpendicular flaps 32*b* in the vertical direction. Moreover, the perpendicular flaps 32 may also be perpendicular flaps 32 whose lengths in the airflow direction are about the same and where the length of the small perpendicular flaps 32*a* in the vertical direction is designed to be shorter than the length of the large perpendicular flaps 32*b* in the vertical direction.

(3) Reference Example

The occurrence of drain water can be suppressed even in a case where other flaps having the following configuration are placed instead of the small perpendicular flaps 32*a* described above. These other flaps are flaps which, in a case where they are placed instead of the small perpendicular flaps 32*a* in the positions where the small perpendicular flaps 32*a* described above had been placed, can reduce the quantity of drain water that can arise more than the quantity of drain water that can arise between the large perpendicular flaps 32*b* and the support members 33 in a case where the lame perpendicular flaps 32*b* described above are placed instead in the same positions.

In this way, other flaps may be used for the perpendicular flaps 32 that are placed nearest to the support members 33, and the perpendicular flaps 32 other than those other flaps may be given a configuration differing from those other flaps. That is, the perpendicular flaps 32 may also be configured from least two types of flaps including other flaps. The types of flaps here are divided by, for example, shape, size, whether or not they have been surface-treated, etc.

INDUSTRIAL APPLICABILITY

The indoor unit of an air conditioning apparatus of the present invention can suppress dew condensation that can arise between a perpendicular flap and a support member in a case where, for example, a horizontal flap is supported in such a way that it may freely rotate by a support member, so the indoor unit of an air conditioning apparatus of the present invention is particularly useful in a case where it is applied to an indoor unit of an air conditioning apparatus where a horizontal flap is supported by a support member.

What is claimed is:

1. An indoor unit of an air conditioning apparatus, the indoor unit comprising:

a casing having an air inlet and an air outlet;

a heat exchanger placed inside the casing;

a fan arranged to generate an airflow leading from the air inlet to the air outlet;

a first airflow direction adjusting plate arranged and configured to adjust a direction of the airflow blown out from the air outlet by rotation about a first direction corresponding to an axial direction of the first airflow direction adjusting plate;

a plurality of second airflow direction adjusting plates arranged and configured to adjust the direction of the airflow blown out from the air outlet by rotation about a second direction that is substantially perpendicular with respect to the first direction; and at least one support member rotatably supporting the first airflow direction adjusting plate with respect to the casing at least in a portion of the air outlet other than both end portions along the first direction, the plurality of the second airflow direction adjusting plates including at least one third airflow direction adjusting plate adjacent to the support member on one side and at least one fourth airflow direction adjusting plate adjacent to the opposite side of the support member placed in a location such that a distance to the support member from the fourth airflow direction adjusting plate is smaller than a distance to the support member from the third airflow direction adjusting plate, and a size of the fourth airflow direction adjusting plate being smaller than a size of the third airflow direction adjusting plate in a vertical direction substantially perpendicular to the direction of the airflow, in order to prevent condensation from forming on the fourth airflow direction adjusting plate and the support member.

2. The indoor unit of an air conditioning apparatus according to claim 1, wherein the support member and the plurality of the second airflow direction adjusting plates are placed in positions where they do not overlap each other when viewed along the direction of the airflow passing through the air outlet in the casing.

3. The indoor unit of an air conditioning apparatus according to claim 1, wherein a distance of closest approach between a shaft of the fourth airflow direction adjusting plate and the support member is the shortest among distances of closest approach between shafts of the plurality of the second airflow direction adjusting plates and the support member.

4. The indoor unit of an air conditioning apparatus according to claim 1, wherein a distance of closest approach between a rotational driving locus of the fourth airflow direction adjusting plate and the support member is the shortest among distances of closest approach between rotational driving loci of the plurality of the second airflow direction adjusting plates and the support member.

5. The indoor unit of an air conditioning apparatus according to claim 1, wherein the plurality of the second airflow direction adjusting plates are placed side-by-side along the first direction, and at least parts of the second airflow direction adjusting plates and the support member overlap as viewed along the first direction.

6. The indoor unit of an air conditioning apparatus according to claim 5, wherein the support member has a plate portion that extends in the direction of the airflow passing through the air outlet, and a thickness direction of the plate portion is the first direction.

7. The indoor unit of an air conditioning apparatus according to claim 6, wherein in a state where a distance of closest approach between the support member and the fourth airflow direction adjusting plate becomes smallest as a result of the fourth airflow direction adjusting plate rotating, an angle on a downwind side in the airflow direction of angles formed by the support member and the fourth airflow direction adjusting plate is from 10 degrees to 90 degrees as viewed along the second direction.

8. The indoor unit of an air conditioning apparatus according to claim 1, wherein the first airflow direction adjusting plate is arranged and configured to adjust in an up-and-down direction the direction of the airflow blown out from the air outlet, and the plurality of the second airflow direction adjusting plates are arranged and configured to adjust in a left-and-right direction the direction of the airflow blown out from the air outlet.

9. The indoor unit of an air conditioning apparatus according to claim 1, wherein the casing has only one air outlet, and a lengthwise direction of the air outlet is a substantially horizontal direction.

10. The indoor unit of an air conditioning apparatus according to claim 1, wherein the size of the fourth airflow direction adjusting plate is the smallest among the sizes of the plurality of the second airflow direction adjusting plates.

11. The indoor unit of an air conditioning apparatus according to claim 1, wherein the indoor unit is a ceiling-suspended type.

12. The indoor unit of an air conditioning apparatus according to claim 2, wherein a distance of closest approach between a shaft of the fourth airflow direction adjusting plate and the support member is the shortest among distances of closest approach between shafts of the plurality of the second airflow direction adjusting plates and the support member.

13. The indoor unit of an air conditioning apparatus according to claim 2, wherein a distance of closest approach between a rotational driving locus of the fourth airflow direction adjusting plate and the support member is the shortest among distances of closest approach between rotational driving loci of the plurality of the second airflow direction adjusting plates and the support member.

14. The indoor unit of an air conditioning apparatus according to claim 2, wherein the plurality of the second airflow direction adjusting plates are placed side-by-side along the first direction, and at least parts of the second airflow direction adjusting plates and the support member overlap as viewed along the first direction.

15. The indoor unit of an air conditioning apparatus according to claim 3, wherein the plurality of the second airflow direction adjusting plates are placed side-by-side along the first direction, and at least parts of the second airflow direction adjusting plates and the support member overlap as viewed along the first direction.

16. The indoor unit of an air conditioning apparatus according to claim 4, wherein the plurality of the second airflow direction adjusting plates are placed side-by-side along the first direction, and at least parts of the second airflow direction adjusting plates and the support member overlap as viewed along the first direction.

17. The indoor unit of an air conditioning apparatus according to claim 1, wherein a first area which is an overlapped area between the third airflow direction adjusting plate and the support member as viewed along the first direction is larger than a second area which is an overlapped area between the fourth airflow direction adjusting plate and the support member as viewed along the first direction.

* * * * *